US008656519B2

(12) United States Patent
Kuo

(10) Patent No.: US 8,656,519 B2
(45) Date of Patent: Feb. 25, 2014

(54) POSITION CONTROL MECHANISM FOR A FULL-FACED AND OPEN-FACED HELMET

(75) Inventor: Hsuan-Chin Kuo, Tainan (TW)

(73) Assignee: Kin Yong Lung Industrial Co., Ltd., Tainan (TW)

( * ) Notice: Subject to any disclaimer, the term of this patent is extended or adjusted under 35 U.S.C. 154(b) by 380 days.

(21) Appl. No.: 13/104,128

(22) Filed: May 10, 2011

(65) Prior Publication Data

US 2012/0284906 A1 Nov. 15, 2012

(51) Int. Cl.
*A42B 1/24* (2006.01)

(52) U.S. Cl.
USPC ..... 2/422

(58) Field of Classification Search
USPC ..... 2/422–424
See application file for complete search history.

(56) References Cited

U.S. PATENT DOCUMENTS

| | | | | |
|---|---|---|---|---|
| 7,024,704 | B2 * | 4/2006 | Gafforio et al. | 2/424 |
| 2003/0182716 | A1 * | 10/2003 | Wu | 2/424 |
| 2007/0124851 | A1 * | 6/2007 | Pyo | 2/424 |
| 2008/0216215 | A1 * | 9/2008 | Lee | 2/424 |

* cited by examiner

*Primary Examiner* — Katherine Moran
(74) *Attorney, Agent, or Firm* — Rosenberg, Klein & Lee

(57) ABSTRACT

The position control mechanism is provided to be pivotally mounted on a side of a full-faced and open-faced helmet. The position control mechanism includes at least a helmet body, at least a pair of control units, at least a chin guard and at least a visor plate. A pair of inserting feet are disposed in each side of the chin guard and a pair of inserting feet disposed on a fixing unit in each inward hollow of the chin guard, so as to move each adjusting article to be operated to adjust the positions of the chin guard and the visor plate of the helmet.

6 Claims, 7 Drawing Sheets

POSITION CONTROL MECHANISM FOR A FULL-FACED AND OPEN-FACED HELMET

BACKGROUND OF THE INVENTION

1. Field of the Invention

The present invention is related to a position control mechanism pivotally mounted on a side of a full-faced and open-faced helmet, and more particularly to a position control mechanism which is provided with a pair of inserting feet disposed on each pivotal ear portion of the chin guard and a pair of inserting feet disposed on each fixing unit, so as to move each adjusting article to be operated to adjust the positions of the chin guard and the visor plate of the helmet.

2. Description of the Related Art

Generally, there are two different kinds of helmets for motorcycle riders. One is full-faced, and the other one is open-faced. They both have to be passed through safety inspection before being sold in the market. Accordingly, a manufacturer of helmets must pay much more inspection cost to obtain the certificates of inspection for different kinds of helmets.

On the other hand, an open-faced helmet is light, ventilative and convenient to wear, but it can not provide full protection for a wearer's face and chin from cold wind or rain. A full-faced helmet can provide full protection for a wearer's face and chin, but it is not convenient to wear and less ventilative.

BRIEF SUMMARY OF THE INVENTION

Accordingly, in order to solve the above-mentioned problems, one primary objective of the present invention is to provide a position control mechanism for a full-faced and open-faced helmet that substantially obviates the drawbacks of the related prior art.

Another primary objective of the present invention is to provide a position control mechanism that is pivotally mounted on a side of a full-faced and open-faced helmet for adjusting the positions of a chin guard and a visor plate.

Still another primary objective of the present invention is to provide a position control mechanism that can be easily operated according to the movement of a chin guard or a visor plate between activated and retracted positions.

To realize these advantages, the present invention provides a position control mechanism pivotally mounted on a side of a full-faced and open-faced helmet. The position control mechanism includes at least a helmet body, at least a pair of control units, at least a chin guard and at least a visor plate. A pair of inserting feet are disposed on each side of the chin guard and a pair of inserting feet disposed on a fixing unit in each inward hollow of the chin guard, so as to move each adjusting article to be operated to adjust the positions of the chin guard and the visor plate of the helmet.

BRIEF DESCRIPTION OF THE DRAWINGS

The invention as well as a preferred mode of use, further features and advantages thereof will best be understood by reference to the following detailed description of the illustrative embodiment when read in conjunction with the accompanying drawings, wherein.

DETAILED DESCRIPTION OF THE PREFERRED EMBODIMENT

The present invention discloses a position control mechanism pivotally mounted on a side of a full-faced and open-faced helmet for adjusting the positions of a chin guard 3 and a visor plate 4 in the helmet, and some detailed parts of process for manufacturing or processing the position control mechanism are accomplished by applying prior art. Therefore, these parts will not be completely depicted in the description below. The drawings referred in the following are not made according to the actual related sizes, and the function of these drawings is only for illustrating characteristics related to the present invention.

Figure 1:
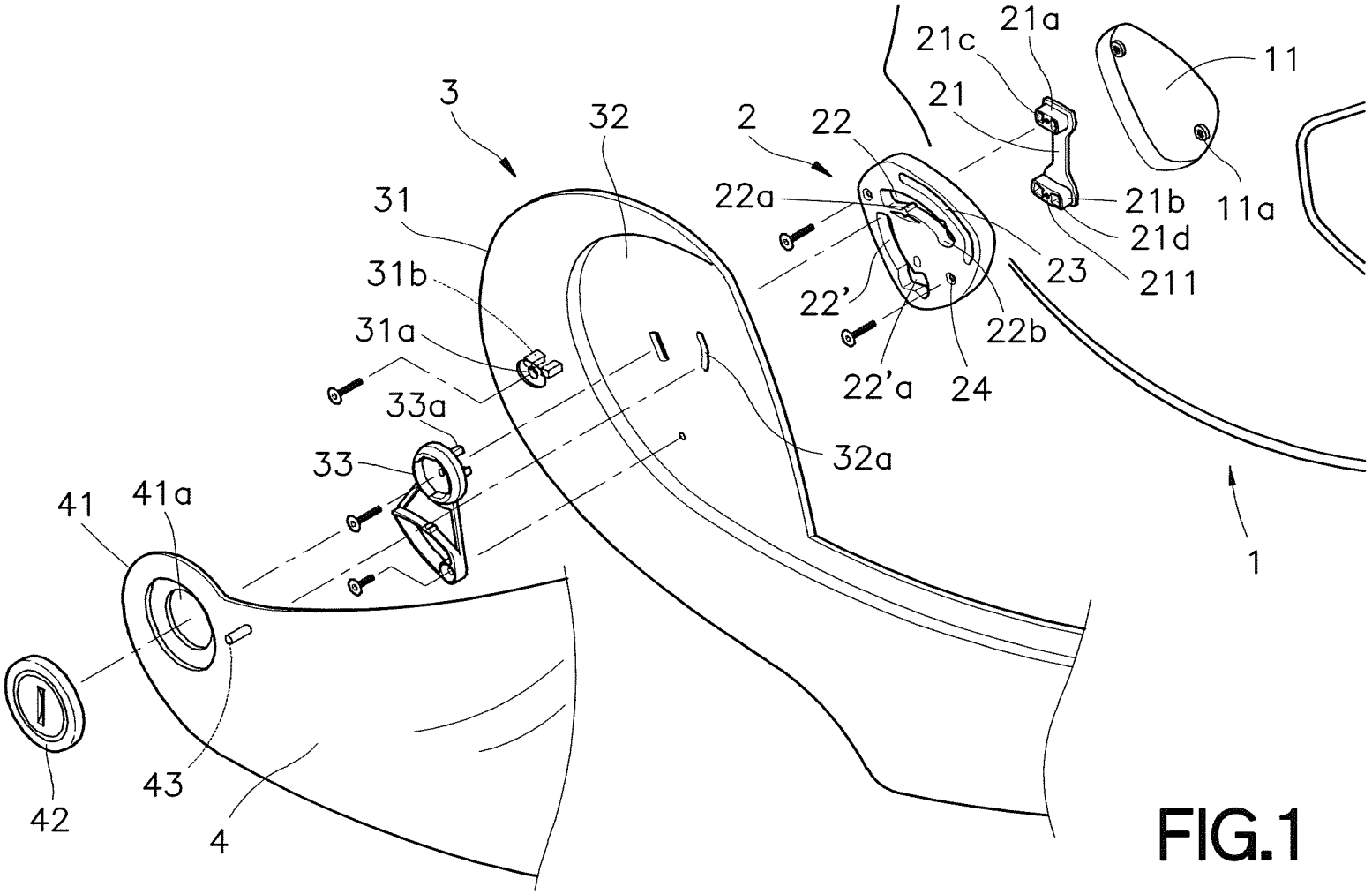
FIG. 1 is a perspective exploded view of the preferred embodiment of the position control mechanism for a full-faced and open-faced helmet in accordance with the present invention.

FIG. 1 is a perspective exploded view of the preferred embodiment of the position control mechanism according to the present invention. The position control mechanism is assembled by a helmet body 1, at least a pair of control units 2, at least a chin guard 3 and at least a visor plate 4. A hollow 11 is disposed in each pivotal ear portion of the helmet body 1, and at least a screw hole 11*a* is disposed in each hollow 11. Each control unit 2 includes at least an adjusting element 21, each adjusting element 21 is provided with an upper distal end 21*a* and a lower distal end 21*b*, at least an upper inserting hole 21*c* and a screw hole are disposed in each upper distal end 21*a*, and at least a lower inserting hole 21*d* and a screw hole 211 are disposed in each lower distal end 21*b*. At least an upper sliding groove 22 and at least a lower sliding groove 22' are disposed in each control unit 2, at least an flange 22*a* and at least an upper catching hollow 22*b* are disposed in each upper sliding groove 22, at least a lower catching hollow 22'*a* is disposed in each lower sliding groove 22', and at least an elongated slot 23 and screw holes 24 are disposed at one side of each upper sliding groove 22. At least an inward hollow 32 is is disposed at each pivotal ear portion 31 of the chin guard 3, at least a fixing unit 33 is pivotally provided in each inward hollow 32, at least a pair of inserting feet 33*a* are disposed at one side of each fixing unit 33, at least a guide hole 32*a* is disposed in each inward hollow 32, at least a screw hole 31*a* is disposed at one side of each inward hollow 32, and at least a pair of inserting feet 31*b* are disposed at the other side of each inward hollow 32. A pivotal ear portion 41 is formed at each side of the visor plate 4, a through hole 41*a* is disposed in each pivotal ear portion 41, each through hole 41*a* is disposed for a fixing article 42 to be inlaid in, and at least a guide rod 43 is disposed at one side of each through hole 41*a* of the visor plate 4.

Figure 2:
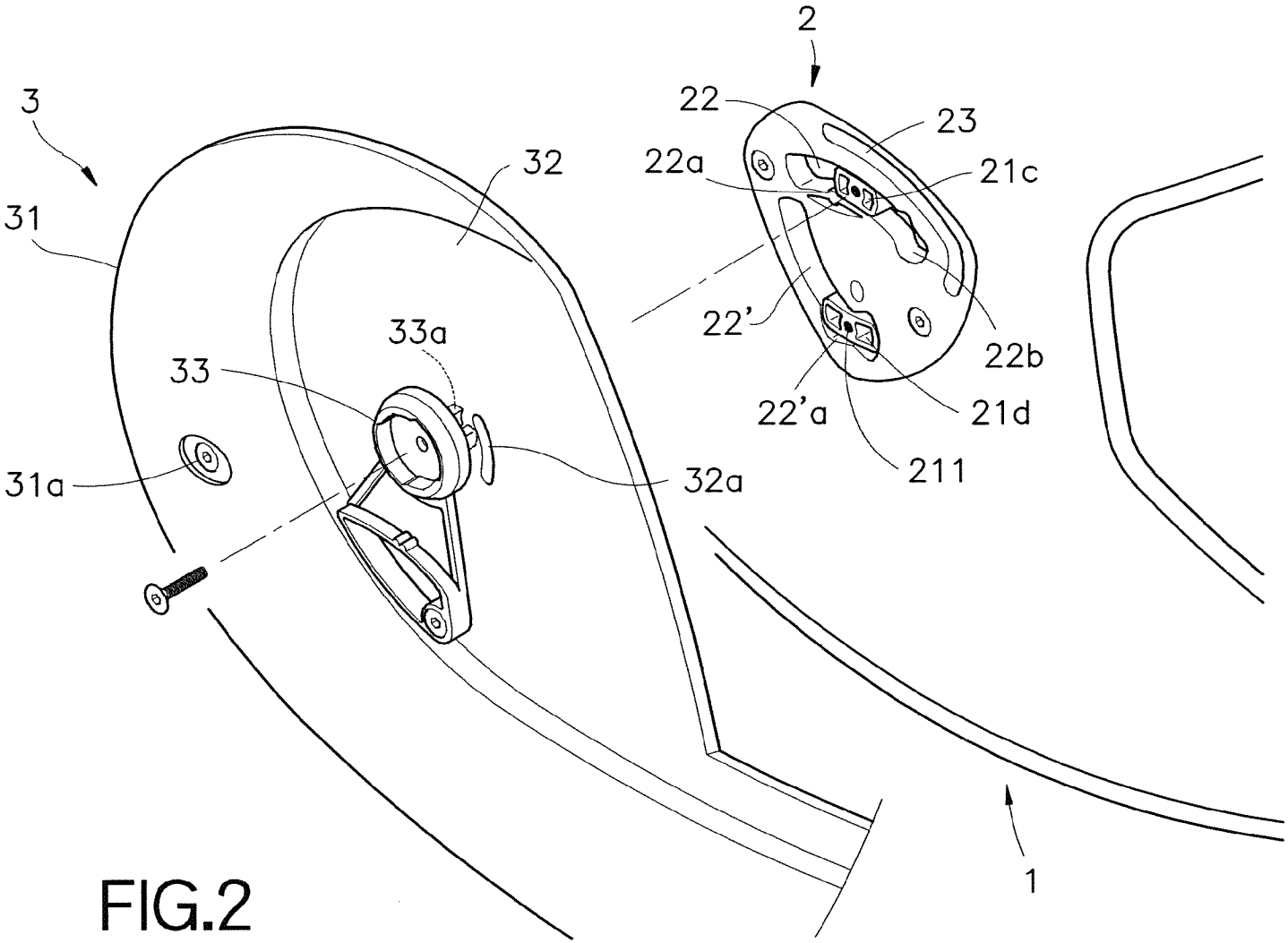
FIG. 2 is a perspective exploded view of the preferred embodiment of the control unit and the chin guard of the position control mechanism in accordance with the present invention.
Figure 3:
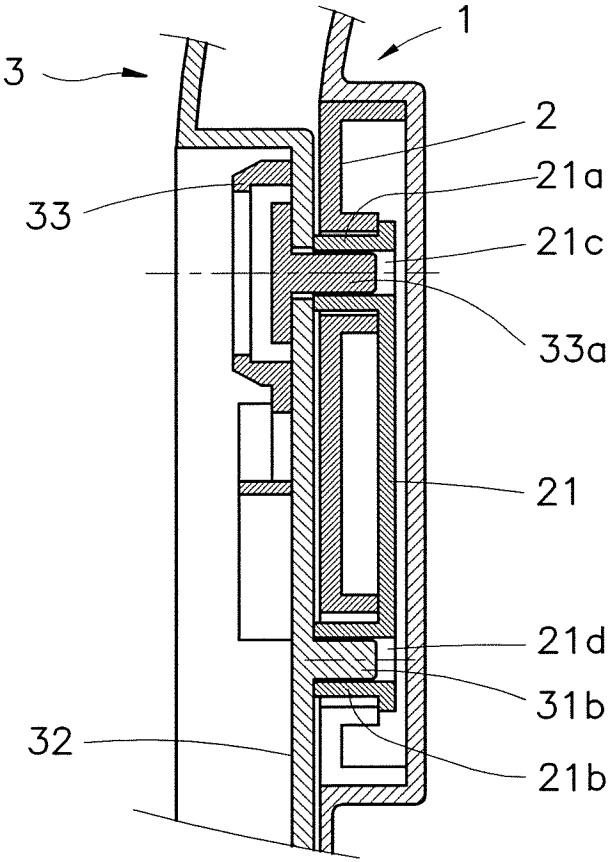
FIG. 3 is a sectional view of the preferred embodiment of the control unit and the chin guard of the position control mechanism in an assembled configuration in accordance with the present invention.
Figure 4:
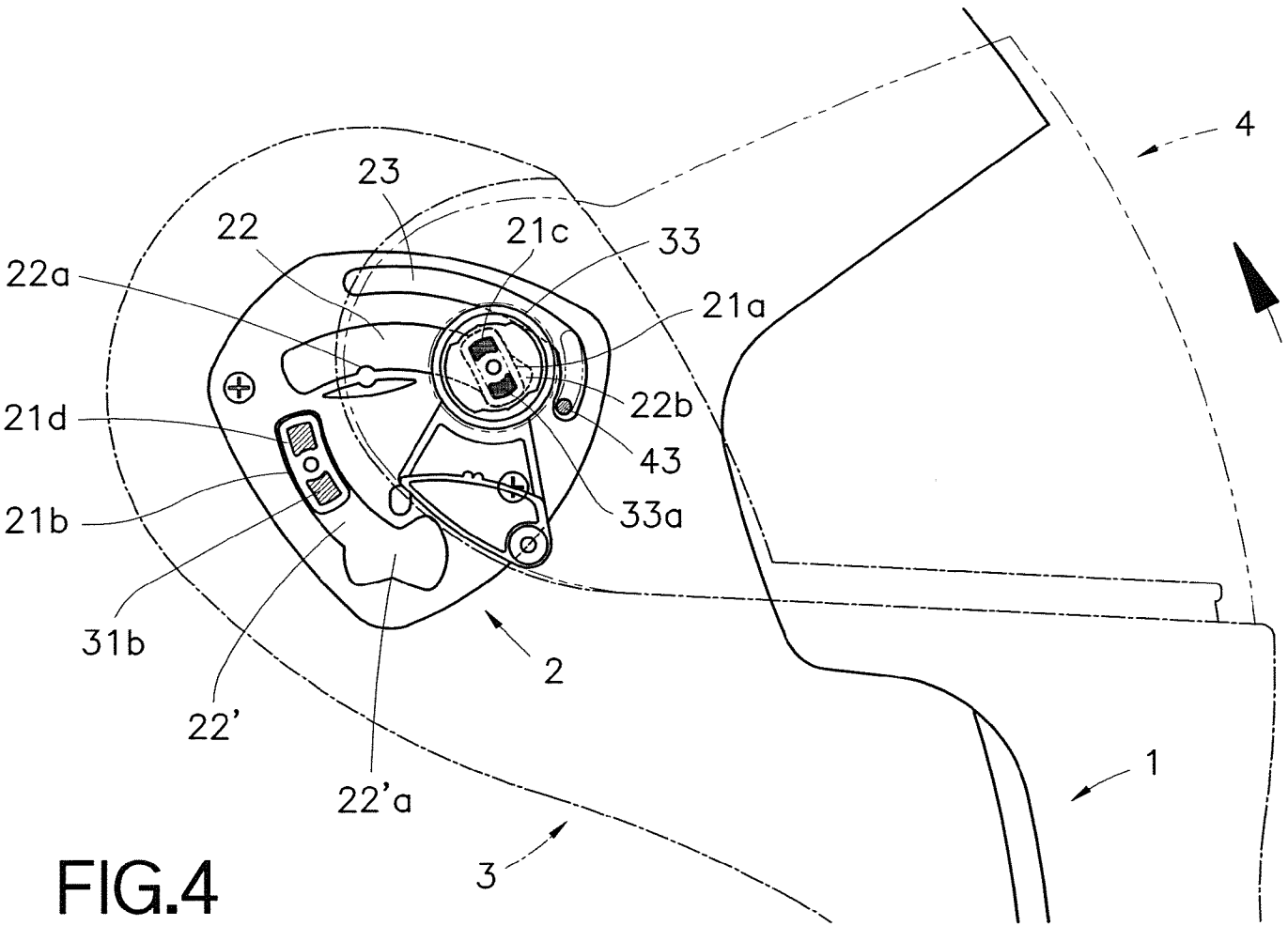
FIG. 4 is a side elevational schematic view of the preferred embodiment of the position control mechanism for a full-faced and open-faced helmet in its activated configuration for use in accordance with the present invention.
Figure 5:
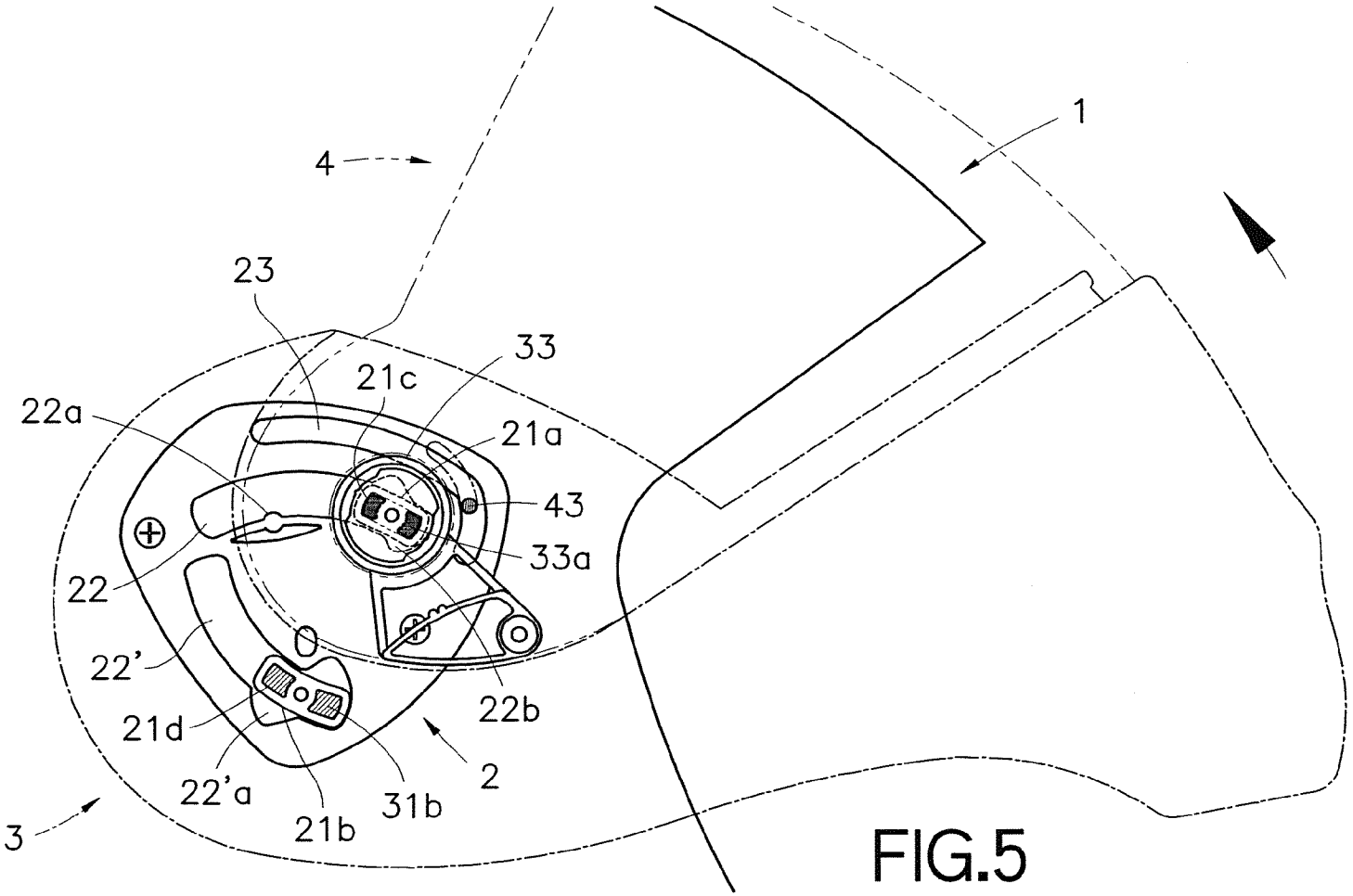
FIG. 5 is another side elevational schematic view of the preferred embodiment of the position control mechanism for a full-faced and open-faced helmet in its activated configuration for use in accordance with the present invention.
Figure 6:
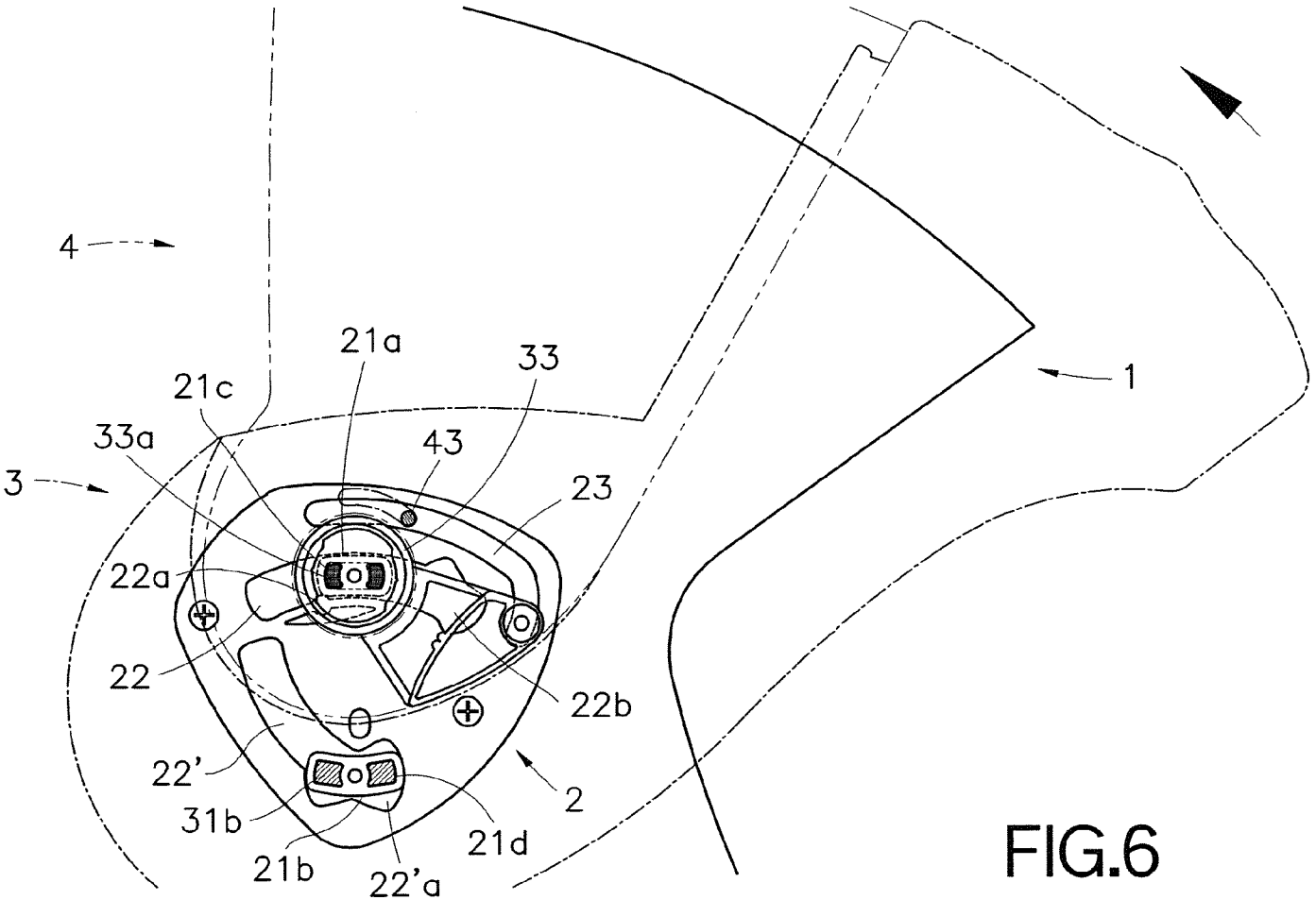
FIG. 6 is still another side elevational schematic view of the preferred embodiment of the position control mechanism for a full-faced and open-faced helmet in its activated configuration for use in accordance with the present invention; and, FIG. 7 is yet another side elevational schematic view of the preferred embodiment of the position control mechanism for a full-faced and open-faced helmet in its activated configuration for use in accordance with the present invention.
Figure 7:
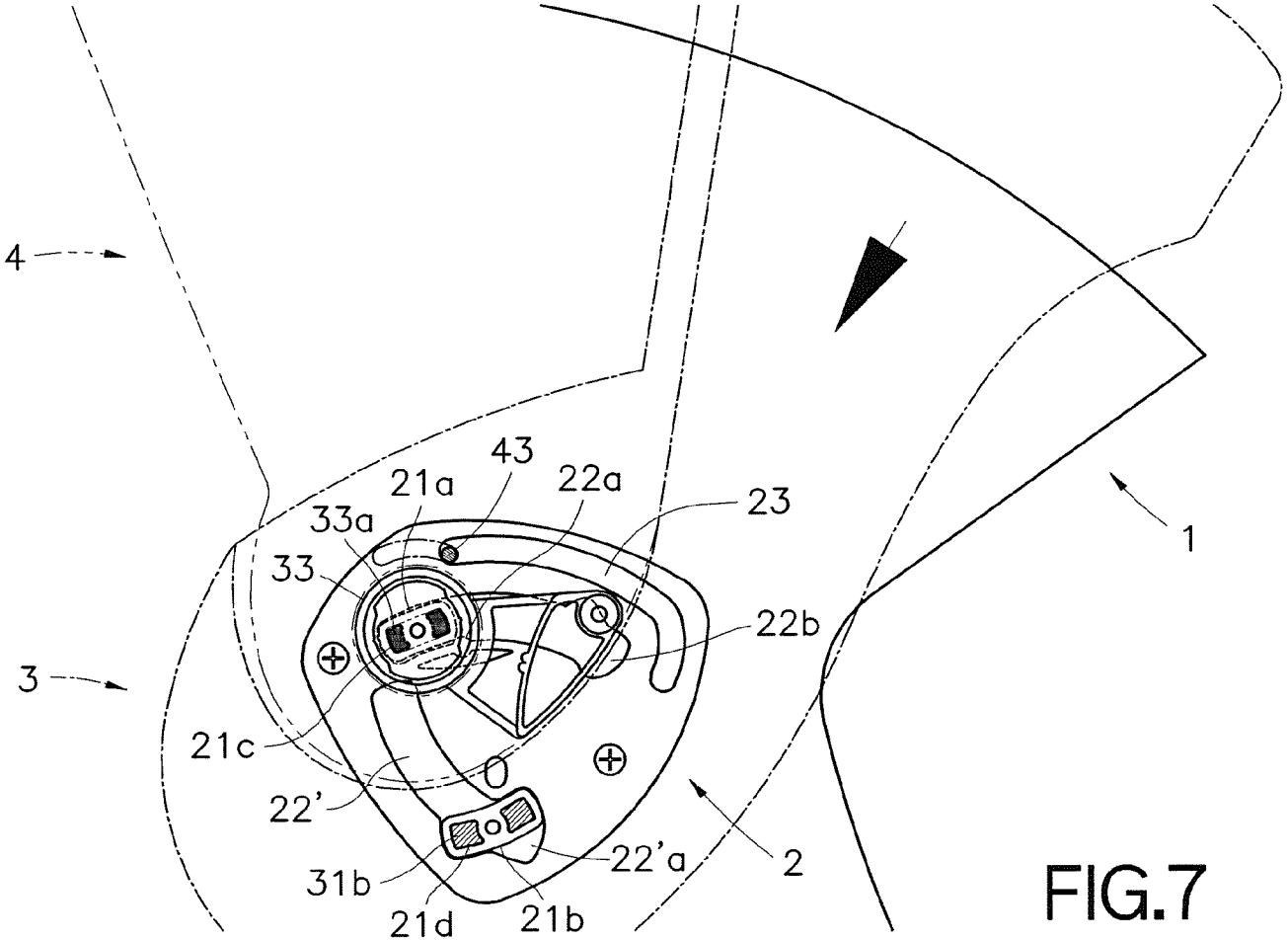

While being assembled, as shown in FIGS. 1, 2, and 3, each control unit 2 is screwed in each hollow 11 of the helmet body 1, each through hole 41*a* at each pivotal ear portion 41 of the visor plate 4 is sleeved into each inward hollow 32 of each pivotal ear portion 31 and each fixing unit 33, and each guide rod 43 is inserted into each guide hole 32*a* of each inward hollow 32, so as for each through hole 41*a* and each guide rod 43 respectively accordingly to be placed into each head portion of each control unit 2 and each guide hole 32*a* of the chin guard 3. Then, each pair of inserting feet 31*b* of the chin guard 3 and each pair of inserting feet 33*a* of each fixing unit 33 are respectively inserted into the upper inserting hole 21*c* and the lower inserting hole 21*d* of each adjusting element 21, so as for the helmet body 1, control units 2, the chin guard 3 and the visor plate 4 to be assembled together, and each fixing article 42 is screwed to each through hole 41*a* of the visor plate 4 to finish assembly.

While being activated, referring to FIGS. 4, 5, 6 and 7, when the chin guard 3 is moved upward, the upper distal end 21*a* as well as the upper inserting hole 21*c* and the lower distal end 21*b* as well as the lower inserting hole 21*d* of each adjusting element 21 will be respectively moved in the upper sliding groove 22 and the lower sliding groove 22' of each control unit 2 according to the movement of each pair of inserting feet 31*b* of the chin guard 3 and each pair of inserting feet 33*a* of each fixing unit 33. When the upper distal end 21*a* of each adjusting element 21 is against the flange 22*a* of each upper sliding groove 22, the lower distal end 21*b* of each adjusting element 21 will be caught in the lower catching hole 22'*a* in each lower sliding groove 22', and the chin guard 3 and the visor plate 4 will be in open-faced position. Then, when the upper distal end 21*a* of each adjusting element 21 moves over the flange 22*a* of each upper sliding groove 22, the lower distal end 21*b* of each adjusting element 21 will be wholly inlaid in the lower catching hole 22'*a* in each lower sliding groove 22', and the chin guard 3 and the visor plate 4 will be against the top surface of the helmet body 1. On the contrary, when the chin guard 3 is moved downward, the upper distal end 21*a* of each adjusting element 21 is moved over the flange 22*a* of each upper sliding groove 22 and then wholly inlaid in the upper catching hollow 22*b* in each upper sliding groove 22, the lower distal end 21*b* of each adjusting element 21 is moved in each lower sliding groove 22', and the chin guard 3 and the visor plate 4 are in open-faced position. According to the movement as above-mentioned, each guide rod 43 of the visor plate 4 is sliding in each elongated slot 23 of each control unit 2 so as for the visor plate 4 to be activated.

By means of the control units 2 and the adjusting elements 21, the positions of the chin guard 3 and the visor plate 4 can be easily adjusted between activated and retracted, so as for the helmet to have open-faced or full-faced function.

While the present invention has been described above by way of examples and in terms of the preferred embodiment, it is to be recognized and understood that the present invention is not limited to the disclosed embodiment, it is intended to cover various modifications and similar arrangements as may be made thereto, and the scope of the appended claims should be accorded the broadest interpretation so as to encompass all such modifications which may fall within the spirit and the invention.

What is claimed is:

1. A position control mechanism for a full-faced and open-faced helmet, comprising:

a helmet body being provided with at least a hollow, said hollow being disposed in each pivotal ear portion of said helmet body, and at least a screw hole being disposed in each said hollow;

at least a pair of control units, each said control unit being provided with at least an adjusting element;

at least a chin guard, at least an inward hollow being disposed at each pivotal ear portion of said chin guard, at least a fixing unit being pivotally provided in each said inward hollow, at least a guide hole being disposed in each said inward hollow, and at least a screw hole being disposed at one side of each said inward hollow; and, at least a visor plate being provided with a pivotal ear portion formed at each side of said visor plate, a through hole being disposed in each said pivotal ear portion, each said through hole being disposed for a fixing article to be inlaid in, and at least a guide rod being disposed at one side of each said through hole of said visor plate;

wherein at least an upper sliding groove and at least a lower sliding groove are disposed in each said control unit, and at least a flange is disposed in each said upper sliding groove.

2. The position control mechanism for a full-faced and open-faced helmet according to claim 1, wherein each said adjusting element is provided with an upper distal end and a lower distal end, at least an upper inserting hole and a screw hole are disposed in each said upper distal end, and at least a lower inserting hole and a screw hole are disposed in each said lower distal end.

3. The position control mechanism for a full-faced and open-faced helmet according to claim 1, wherein at least an upper catching hollow is disposed in each said upper sliding groove, and at least a lower catching hollow is disposed in each said lower sliding groove.

4. The position control mechanism for a full-faced and open-faced helmet according to claim 3, wherein at least an elongated slot and screw holes are disposed at one side of each said upper sliding groove.

5. The position control mechanism for a full-faced and open-faced helmet according to claim 1, wherein at least a pair of inserting feet are disposed at one side of each said fixing unit.

6. The position control mechanism for a full-faced and open-faced helmet according to claim 1, wherein at least a pair of inserting feet are disposed at one side of each said inward hollow of said chin guard.

* * * * *